United States Patent [19]

Berggren

[11] Patent Number: 4,870,236

[45] Date of Patent: Sep. 26, 1989

[54] APPARATUS USING MICROWAVE ENERGY FOR HEATING CONTINUOUSLY PASSING GOODS ALONG A WIDE PATH

[75] Inventor: Benny Berggren, Vällingby, Sweden

[73] Assignee: Alfastar AB, Tumba, Sweden

[21] Appl. No.: 312,305

[22] Filed: Feb. 17, 1989

Related U.S. Application Data

[63] Continuation of Ser. No. 110,708, filed as PCT SE87/00046 on Feb. 2, 1987, published as WO87/04888 on Aug. 13, 1987, abandoned.

[30] Foreign Application Priority Data

Feb. 11, 1986 [SE] Sweden ..... 8600608

[51] Int. Cl.[4] ..... H05B 6/78

[52] U.S. Cl. ..... 219/10.55 A; 219/10.55 F

[58] Field of Search ..... 219/10.55 A, 10.55 F, 219/10.55 E, 10.55 R

[56] References Cited

U.S. PATENT DOCUMENTS

| | | | |
|---|---|---|---|
| 3,848,106 | 11/1974 | Berggren et al. | 219/10.55 A |
| 4,160,145 | 7/1979 | Rueggeberg | 219/10.55 F |
| 4,184,060 | 1/1980 | Lembens | 219/10.55 M X |
| 4,348,572 | 9/1982 | Moule | 219/10.55 A |
| 4,351,998 | 9/1982 | Keppel et al. | 219/10.55 R |
| 4,435,629 | 3/1984 | Ishimaru et al. | 219/10.55 A |
| 4,622,448 | 11/1986 | Awata et al. | 219/10.55 A |
| 4,631,380 | 12/1986 | Tran | 219/10.55 A |

FOREIGN PATENT DOCUMENTS 415723 10/1980 Sweden .

*Primary Examiner*—Philip H. Leung

*Attorney, Agent, or Firm*—Nies, Webner, Kurz & Bergert

[57] ABSTRACT

An arrangement for heating with the aid of microwave energy, comprising a microwave generator constructed to supply a waveguide, the waveguide having provided in one side surface thereof a dielectric plate through which microwave energy propagates. In accordance with the invention the arrangement includes at least two microwave generators (1, 2), each of which is arranged to supply a feed waveguide (3, 4). The feed waveguide (3, 4) is a power divider which is arranged to distribute the power input substantially equally to at least two applicators (7, 8; 9, 10) which extend at an angle to the feed waveguide, where each of the at least four applicators (7, 8; 9, 10) is provided on one side surface thereof with a dielectric plate (11, 12, 14) of the aforesaid kind. The applicators are positioned in relation to one another so that all dielectric plates (11, 12, 14) lie in one and the same plane.

9 Claims, 2 Drawing Sheets

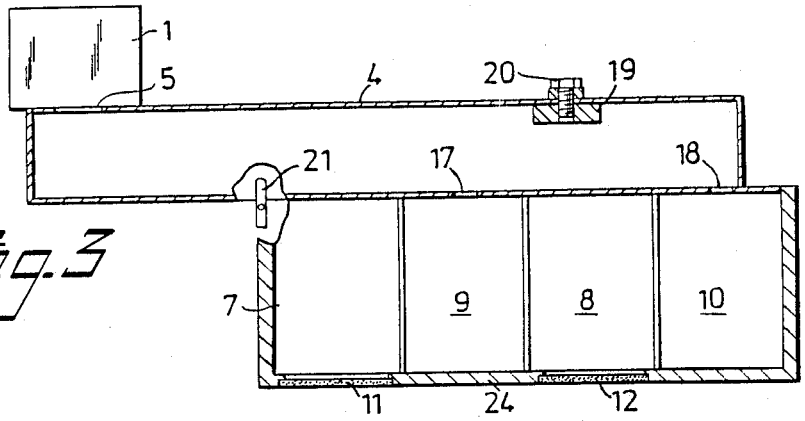
Fig. 3
Fig. 4
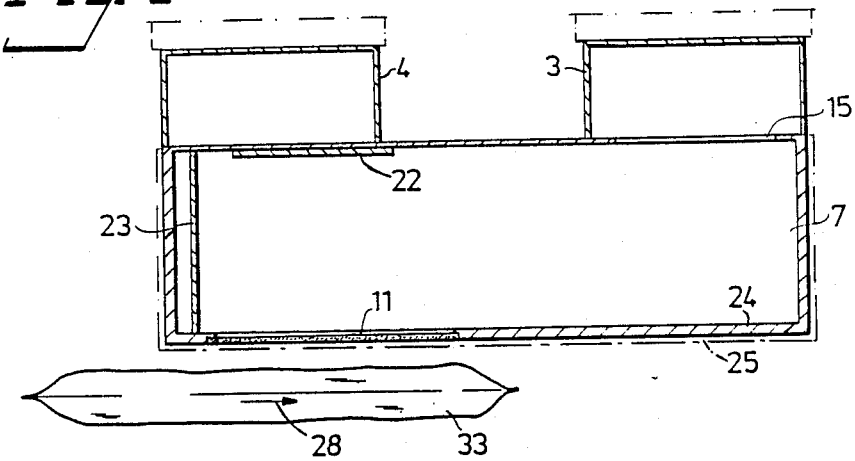
Fig. 5
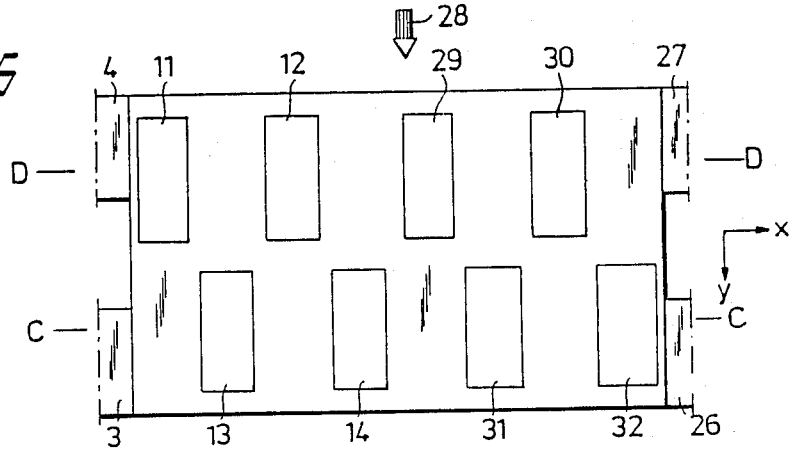
Fig. 6
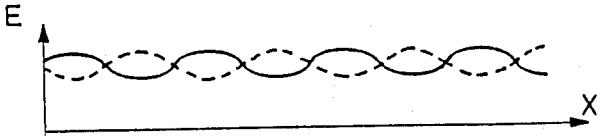

APPARATUS USING MICROWAVE ENERGY FOR HEATING CONTINUOUSLY PASSING GOODS ALONG A WIDE PATH

This application is a continuation of application Ser. No. 110,708, filed as PCT SE87/00046 on Feb. 2, 1987, published as WO87/04888 on Aug. 13, 1987, now abandoned.

The present invention relates to an arrangement for heating with the aid of microwave energy. The invention particularly relates to an arrangement for heating continuously passing goods, such as foodstuffs, which are transported on a conveyor path of significant width.

Microwave applicators of the kind which include a metal waveguide that has a dielectric plate inserted in one side surface thereof are known to the art. One such microwave applicator is described and illustrated in Swedish Pat. Specification No. 366 456 and its corresponding U.S. Pat. No. 3,848,106.

In the case of a microwave applicator of this known construction, material passed over the dielectric plate is heated in accordance with the distribution of microwaves propogating from the plate. The wave propogation modes for the occurent microwave energy are influenced, inter alia, by the dimensions of the dielectric plate.

Large dielectric plates give rise to several modes of higher orders, and hence the distribution of energy above the plate is, to some extent, uncontrolled in the case of large plates.

With regard to the use of such microwave applicators for heating foodstuffs, it is desirable to use a foodstuff conveyor that presents a treatment or processing width of, e.g., 400mm. In the case of widths of this magnitude it is unsuitable to use solely one dielectric plate having a length of 400mm or thereabove, since the distribution of energy above the plate will be too uneven.

It is desirable when heating by means of microwave energy in the aforesaid context to advance foodstuffs in a tunnel that contains water, the cross-sectional dimensions of the tunnel constituting the desired treatment width, which is about 400mm, and the depth corresponding to the thickness or vertical extension of the foodstuff. In accordance with one embodiment, the foodstuff is packed in plastic packages which are passed into the tunnel in a controlled manner at a given speed. In one application it is desired to heat the foodstuff rapidly from a temperature of about 70° C. to about 130° C., in a manner which will ensure that this latter temperature level is reached precisely and in which the foodstuff is heated uniformly throughout, whereafter this temperature is maintained over a given length of time. In addition hereto, the surface temperature of the packages must not exceed this temperature. Because of this, and for other reasons, the packages of foodstuffs are preferably encased by water in a tunnel. The temperatures to which the foodstuff is heated renders it necessary to maintain the water under pressure, in order to prevent it from boiling away.

In this particular application the microwave applicator is therefore constructed to provide a uniform distribution of energy and also to withstand pressure.

Consequently, in order to fulfill these conditions, the microwave applicator must be compact, even in a direction perpendicular .to the treatment width.

Furthermore, the arrangement shall preferably be readily serviced and capable of utilizing inexpensive magnetrons, while minimizing the number of power units required.

The present invention satisfies all of the aforesaid desiderata and requirements.

In the aforegoing the background of the invention has been described with reference to one particular field of application, namely the processing of foodstuffs. It will be understood, however, that the invention is not restricted solely to this field of application but can be used in all other circumstances where it is required to heat passing goods rapidly and uniformly, particularly in those cases in which the treatment width is relatively large. By large treatment width is meant here and in the following a treatment width which is so large as to prevent controlled uniform heating being achieved with the aid of solely one applicator provided with a dielectric plate.

In summary it can be said that the object of the present invention is to provide a comapct and stable heating arrangement with which microwave energy can be distributed uniformly over a wide surface.

Accordingly, the present invention relates to an arrangement for heating materials with the aid of microwave energy, said arrangement comprising a microwave generator and a wave guide supplied by said generator, the waveguide having provided on one side thereof a dielectric plate through which microwave energy propogates, and is characterized in that the arrangement includes at least two microwave generators each of which is constructed to supply a feed waveguide; in that the feed waveguide is a power divider intended to divide the power applied substantially equally between at least two applicators extending at an angle to the feed waveguide; and in that each of the at least four applicators is provided with a dielectric plate of the aforesaid kind on one side surface of respective applicators; and in that the applicators are so mutually arranged that all dielectric plates lie in mutually the same plane.

The invention will now be described in more detail with reference to exemplifying embodiments thereof illustrated in the accompanying drawings, in which FIG. 1 shows an arrangement according to the invention from the active side of the arrangement;

FIG. 3 is a sectional view taken on the line A—A in FIG. 1;

FIG. 4 is a sectional view taken on the line B—B in FIG. 1, seen from the right in FIG. 1;

FIG. 5 illustrates the active side of an arrangement;

FIG. 6 is a principle diagram illustrating distribution of microwave energy (E) above the active side of the arrangement.

Figure 1:
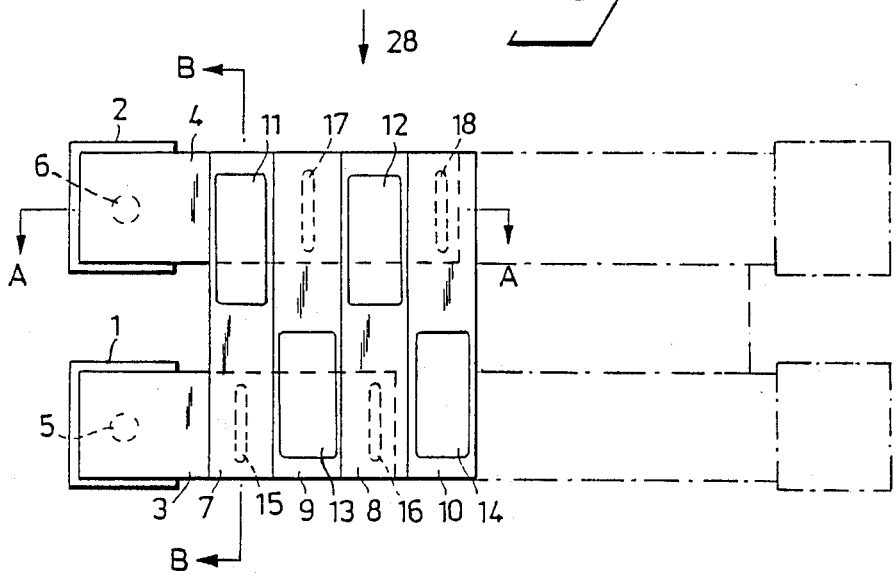
Figure 2:
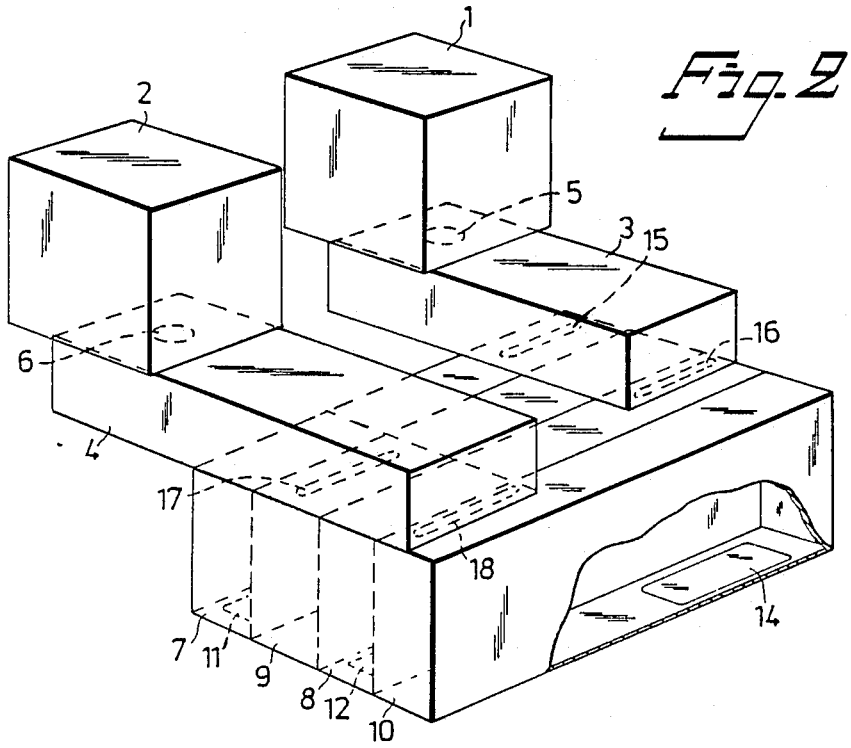
FIG. 2 illustrates in perspective the arrangement shown in FIG. 1 in full lines with the active side of the arrangement facing downwards.

Illustrated to the left of the centre line in FIG. 1 is an arrangement according to the invention, shown in its simplest form. The arrangement is shown in FIG. 2 in a partially broken perspective view.

The arrangement includes microwave generators intended for supplying waveguides and having a dielectric plate through which microwave energy radiates or propogates. The dielectric plate is exemplified hereinafter by a ceramic plate.

In accordance with the present invention the aforesaid arrangement includes at least two microwave generators 1, 2, each being constructed to supply a feed waveguide 3, 4. The microwave generators 1, 2 are connected-up in a conventional manner, for example by means of an aperture 5, 6 in each of the feed waveguides 3, 4. Each feed waveguide 3, 4 is intended to form a power divider, which distributes the power supplied substantially equally to at least two applicators 7, 8; 9, 10 extending at an angle to the waveguide. Thus, each feed waveguide 3, 4 supplies two applicators 7, 8; 9, 10. Each of the at least four applicators 7–10 is provided on one side surface thereof with a ceramic plate 11–14 of the aforesaid kind. In accordance with the invention the applicators are so orientated that all ceramic plates lie in mutually the same plane.

The aforesaid power division is obtained through the agency of two coupling facilities in the form of slots 15, 16; 17, 18 provided in each of the feed waveguides 3, 4 and positioned in the location in which respective applicators are connected to the waveguide. These slots are formed so that substantially half of the power supplied is distributed to each of the two applicators coupled to a feed waveguide.

For the purpose of adjusting the distribution of power between the two applicators, a metal plug 19 (FIG. 3) can be placed in the feed waveguides, centrally between the slots 17, 18. The plug can be secured by means of a screw joint 20. Furthermore, a metal plug 21 can be placed in the feed waveguide, between the magnetron and the slots, in order to reduce or prevent reflection back to the magnetron 1.

Each magnetron preferably operates at a frequency of about 2450MHz. Each magnetron, however, shall operate at a frequency which differs slightly from the respective operating frequencies of the remaining magnetrons, thereby to avoid connection between mutually adjacent ceramic plates. The difference in frequency between two magnetrons having the same stated nominal frequency is normally sufficient to avoid such connection. In addition hereto, the mutual distance between the coupling locations for the applicators supplied by one and the same feed waveguide preferably exceeds $\lambda/2$, in which $\lambda$ is the wavelength in the feed waveguide for the microwave energy generated.

As beforementioned, each applicator includes a ceramic plate through which microwave energy propagates.

The waveguide impedance in the applicators is adapted so that in the loaded state of the ceramic plates, i.e. when the goods to be heated are located outside the plates, microwave energy will pass through the plates and into the goods, therewith heating the same.

As beforementioned, the basic technology regarding the use of a waveguide provided with a ceramic plate is described and illustrated in the Swedish Pat. Specification No. 366 456.

In order to obtain high power generation externally of the ceramic plate, the applicator is provided with a metal adjustment plate which is located approximately opposite the ceramic plate.

In certain instances the applicator has a rectangular configuration, having cross-sectional measurements $a \times b$ where a is normally roughly equal to 2b. The applicator is supplied with microwaves of the $TE_{10}$-mode. Other modes, however, are also excited in the vicinity of the magnetron antenna 5, 6, the plugs 19, 21, the slots 15–18, the adjustment plates 22 and the ceramic plates 11–14. These modes are dampened out, however, by switching their energy to the $TE_{10}$ - mode.

The applicator is short circuited in the vicinity of the slot. The slot is terminated with the ceramic plate in the direction of wave propagation.

The intended length of the applicator can be obtained by incorporating a wall 23 therein.

The arrangement as a whole is made of metal, preferably aluminium, with the exception of the ceramic plates.

As will be seen, inter alia, from FIGS. 1 and 2, the applicators 7–10 are arranged adjacent to and parallel with one another.

In accordance with one preferred embodiment of the invention each applicator extends in a direction opposite to that in which an adjacent applicator extends. Furthermore, in accordance with one preferred embodiment, the applicators and the ceramic plates are so positioned that the plates 11, 12 supplied from one feed waveguide 3 are displaced in relation to the plates 13, 14 supplied from the other feed waveguides 4, in a manner such that the plates 11–14 together form a pattern corresponding to a chess-board pattern, in which however, each plate is spaced from an adjacent plate.

In this respect, the feed waveguides 3,4 also extend parallel with and at a distance from each other. The applicators extend from associated feed waveguides towards the other waveguide.

The aforedescribed mechanical arrangement provides a particularly compact and mechanically rigid and robust assembly which exhibits a wide active surface, while at the same time the magnetrons are postioned to one side of the surface in an advantageous manner from the aspect of service maintenance.

FIG. 5 illustrates an embodiment in which an active surface has been obtained by combining the arrangement shown in full lines in FIG. 1 with the arrangement indicated by chain lines in FIG. 1. It will be readily understood that a still larger active surface can be obtained by expanding the arrangement with additional arrangements placed up and down in the manner illustrated in FIG. 1, with all magnetrons being positioned in a line along one side of the active surface.

In accordance with one embodiment of the invention the arrangement is constructed so that the front plate, i.e. the plate in which the ceramic plates are attached, is common to all applicators. This enables the arrangement to be made to withstand considerable pressure. In this regard the walls located between mutually adjacent applicators form reinforcing web structures for the front plate. The front plate may be provided with a plastic hood 25 which covers the whole of the front plate, in order to obtain a pressure-tight connection between the ceramic plates and the front plate 24.

The plastic hood 25 is shown in broken lines in FIG. 4. The plastic hood is made of a material transparent to microwaves, such as polytetrafluoroethane (Teflon), polypropene or polyethylene.

As beforementioned, the arrangement is preferably made of aluminium. In order to obtain impervious joints between the various components, these components are connected together by means of salt-bath welding processes, in accordance with one preferred embodiment of the invention.

The dielectric plates may be made from various materials. Ceramic material is, at present, preferred since such material combines suitable microwave properties with high mechanical strength and good chemical resistance. One material particularly suitable in this regard is sintered aluminium oxide ($Al_2O_3$, 99%).

In addition to providing a large active surface and being impervious and capable of withstanding gauge pressures, it will be readily seen that with the arrangement according to the invention the number of magnetrons required and the number of power units associated therewith will be halved in comparison with the case when each applicator is supplied from a separate magnetron, as with conventional arrangements.

It is mentioned in the aforegoing that each magnetron supplies two applicators, via a feed waveguide. It will be understood, however, that more than two slots can be provided along the axial extension of the feed waveguide, so as to supply more than two applicators. Furthermore, other coupling devices than slots can be used, such as a series of holes, loops, coils or so-called coupling paths formed in some other manner.

As beforementioned, FIG. 5 illustrates an embodiment of an active surface supplied by four feed waveguides 3, 4, 26, 27. The goods to be heated are passed over the surface 24 in the direction of the arrow 28, i.e. in the y-direction in the x-y-plane.

Conveniently two arrangements are placed at a distance from one another, with the active surfaces 24 facing towards one another, the goods being transported in the gap formed between the active surfaces 24.

The full-line curve shown in FIG. 6 illustrates schematically the distribution of microwave energy over the plates 11, 12, 29, 30 along the line D—D in FIG. 5. As will be seen from the curve, the energy density is at a maximum centrally of respective plates, and diminishes towards the edges thereof.

The broken curve in FIG. 6 illustrates schematically the distribution of microwave energy over the plates 13, 14, 31, 32 along the line C—C in FIG. 5. Since the goods are transported in the direction of arrow 28, the goods will be heated in response to microwave energy delivered by the plates 13, 14, 31, 32 and by microwave energy delivered by the plates 11, 12, 24, 30, hence the thermal energy generated in the goods passing between the plates will correspond to the sum of the two curves.

This, in combination with the fact that the heat generated in the goods is equalized to a certain degree, means that the arrangement according to the invention will provide an extremely uniform increase in the temperature of the passing goods.

In FIG. 4 there is illustrated schematically a plastic package 33 containing, e.g., foodstuffs which pass the plate 11 at a given distance therefrom.

In the most relevant application or use of the present invention, foodstuff is heated in microwave transparent packages which are transported past the active surfaces. The packages are surrounded by water under pressure. Since foodstuff and water have similar properties with regard to microwaves, the foodstuff is heated very uniformly, while avoiding corner and edge effects. The surface temperature of the packages is also kept low, by heat exchange with the surrouding water.

Thus, when practising the present invention it is possible to obtain uniform power distribution over a wide treatment width or area where power distribution is insensitive to variations in load.

Consequently, it is possible to heat foodstuffs rapidly from a temperature, e.g., of 70° C. to 130° C. with a high degree of precision with regard to the final temperature. The treatment width, i.e. the width of the front plate in the x-direction in FIG. 5 may be, for instance, 400mm.

It is therefore obvious that the present invention fulfills the desiderata set forth in the introduction and that the invention affords a solution to the problems recited.

In the aforegoing the invention has been described with reference to a number of embodiments. It will be understood, however, that modifications can be made with regard hereto. For example, more than two applicators can be connected to each feed waveguide. Furthermore, the ceramic plates can be positioned in a pattern different to that shown and described. The feed waveguides may form an angle other than 90° to the applicators etc.

Furthermore, the active surface incorporating a number of dielectric plates may be curved as opposed to the planar surface above described. In such cases the- applicators and feed waveguides will also be curved.

Thus, the present invention is not restricted to the aforedescribed exemplifying embodiments, since modifications can be made within the scope of the following claims.

I claim:

1. An arrangement for heating with the aid of microwave energy, characterized in that the arrangement includes at least two microwave generators (1, 2) and a feed waveguide (3, 4) connected to each microwave generator, each of said microwave generators (1, 2) having a frequency which differs from the frequency of the others of said microwave generators, and said frequency differentials being small, each of said microwave generators enabling supplying microwave energy to its associated feed waveguide (3, 4); in that at least two applicators (7, 8; 9, 10) are structurally associated with and coupled to each said feed waveguide and extend transversely to the associated feed waveguide (3, 4) and wherein each feed waveguide (3, 4) is a power divider enabling distribution of input power substantially equally to said associated at least two applicators (7, 8; 9, 10); in that each of the at least four applicators (7, 8; 9, 10) is a waveguide and each applicator has a single bottom wall and provided in said bottom wall of each said applicator a single dielectric plate (11, 12; 13, 14) whereby microwave energy propagates through and heats material adjacent all of said plates; and in that the applicators are so mutually positioned and relatively arranged that all dielectric plates (11, 12; 13, 14) lie in one and the same plane and said plates in adjacent said applicators are fed with microwave energy from different ones of said microwave generators; said dielectric plates thereby enabling a substantially even energy distribution over the bottoms of said applicators which comprise several plates.

2. An arrangement according to claim 1, characterized in that said applicators (7, 8; 9, 10) lie adjacent to and parallel with one another; and in that each applicator extends from the feed waveguide to which it is coupled in a direction opposite to that in which an adjacent applicator extends.

3. An arrangement according to claim 1 characterized in that said at least two feed waveguides (3, 4) extend from associated microwave generators in parallel spaced apart relationship; and in that said applicator waveguides (7, 8; 9, 10) extend from associated feed waveguides (3; 4) in a direction towards the other feed waveguides (4; 3).

4. An arrangement according to claim 1, characterized in that a front plate (24) is common for all applicators (7, 8; 9, 10), said front plate (24) constituting the bottom wall of each applicator waveguide in which the respective said dielectric plate (11, 12; 13, 14) is provided.

5. An arrangement according to claim 4, characterized in that the front plate (24) is covered by a plastic hood (25) which is transparent to microwaves.

6. An arrangement according to claim 1, characterized in that the applicators (7, 8; 9, 10) are made of aluminium, and that the various components are connected together by means of salt-bath welds.

7. An arrangement according to claim 1, characterized in that the dielectric plates (11, 12) supplied with microwave energy from one (3) of said feed waveguides, are displaced in relation to the dielectric plates (13, 14) supplied with microwave energy from the other (4) of said feed waveguides, such that all said dielectric plates (11, 12; 13, 14) form a pattern corresponding to a chess-board configuration, in which each dielectric plate is spaced from an adjacent one of said dielectric plates.

8. An arrangement according to claim 1, characterized in that the distance between two adjacent coupling locations (15, 16; 17, 18) for to respective applicators (7, 8; 9, 10) along one and the same feed waveguide (3; 4) exceeds $\lambda/2$, where $\lambda$ is the predetermined operating wavelength of the generated microwave energy.

9. An arrangement according to claim 1, characterized in that the dielectric plates are made of a ceramic material.

* * * * *